United States Patent [19]

Westover

[11] Patent Number: 5,064,186

[45] Date of Patent: Nov. 12, 1991

[54] DOCUMENT TRANSPORT APPARATUS

[75] Inventor: Dwight G. Westover, Sierra Madre, Calif.

[73] Assignee: TransTechnology Corporation, Sherman Oaks, Calif.

[21] Appl. No.: 499,727

[22] Filed: Mar. 27, 1990

Related U.S. Application Data

[62] Division of Ser. No. 225,232, Jul. 28, 1988, Pat. No. 4,927,132.

[51] Int. Cl.[5] ..... B65H 29/18; B65H 29/70

[52] U.S. Cl. ..... 271/188; 271/209

[58] Field of Search ..... 271/161, 188, 209, 275

[56] References Cited

U.S. PATENT DOCUMENTS

| | | | |
|---|---|---|---|
| 743,477 | 11/1903 | Förste . | |
| 1,626,352 | 4/1927 | Olson . | |
| 1,987,339 | 1/1935 | Hitchcock . | |
| 2,181,241 | 11/1939 | Klemm . | |
| 2,281,704 | 5/1942 | Matthews | 271/188 |
| 2,464,173 | 3/1949 | Broadmeyer . | |
| 2,767,982 | 10/1956 | Noon . | |
| 2,819,078 | 1/1958 | Durand . | |
| 2,888,261 | 5/1959 | Barnes . | |
| 2,995,364 | 9/1961 | Frederick et al. . | |
| 3,008,709 | 11/1961 | Buslik . | |
| 3,107,089 | 10/1963 | Lockey . | |
| 3,175,824 | 3/1965 | Albosta . | |
| 3,195,887 | 7/1965 | Bean . | |
| 3,532,338 | 10/1970 | Brinson et al. . | |
| 3,595,565 | 7/1971 | Bergland | 271/188 X |
| 3,614,091 | 10/1971 | Bernardis . | |
| 3,770,265 | 11/1973 | Gatti . | |
| 3,861,673 | 1/1975 | Ticknor . | |
| 4,014,539 | 3/1977 | Goodwin . | |
| 4,045,018 | 8/1977 | Michelson . | |
| 4,106,767 | 8/1978 | Schirrmeister | 271/188 |
| 4,350,332 | 9/1982 | Knight | 271/188 |
| 4,362,298 | 12/1982 | Stefansson et al. . | |
| 4,431,179 | 2/1984 | Westover et al. . | |
| 4,448,407 | 5/1984 | Bashford et al. . | |
| 4,483,530 | 11/1984 | Spencer et al. . | |
| 4,506,878 | 3/1985 | Bashford . | |
| 4,522,385 | 6/1985 | Stefansson . | |
| 4,626,313 | 12/1986 | Karp | 271/188 X |
| 4,669,721 | 6/1987 | Westover . | |
| 4,723,773 | 2/1988 | Westover et al. . | |
| 4,724,945 | 2/1988 | Martin . | |

FOREIGN PATENT DOCUMENTS

| | | |
|---|---|---|
| 55-84744 | 6/1980 | Japan . |
| 376554 | 7/1932 | United Kingdom . |

*Primary Examiner*—Richard A. Schacher
*Attorney, Agent, or Firm*—David Weiss

[57] ABSTRACT

Apparatus for transporting documents comprising a first plate member having a document engaging edge along a transport path, for engaging the document on one side thereof; a second plate member having a document engaging edge along the transport path, for engaging the document on the same side as does the first plate member edge; a first drive belt having a document engaging surface along the transport path, for engaging the document on the document's other side; and a second drive belt having a document engaging surface along the transport path, for engaging the document on the same side as does the first drive belt. The plate members and the belts are situated with the first plate member edge, the first belt surface, the second plate member edge and the second belt surface arranged in successive vertically spaced relation such that the belts urge the sheet against the plate member edges when the sheet is engaged by the belt surfaces and the plate member edges. The transport apparatus has particular application as a preloader transport for applying documents from a document feeder to a document loader. There is also disclosed a novel track configuration along which upstanding documents may be advanced.

8 Claims, 3 Drawing Sheets

Fig. 8.
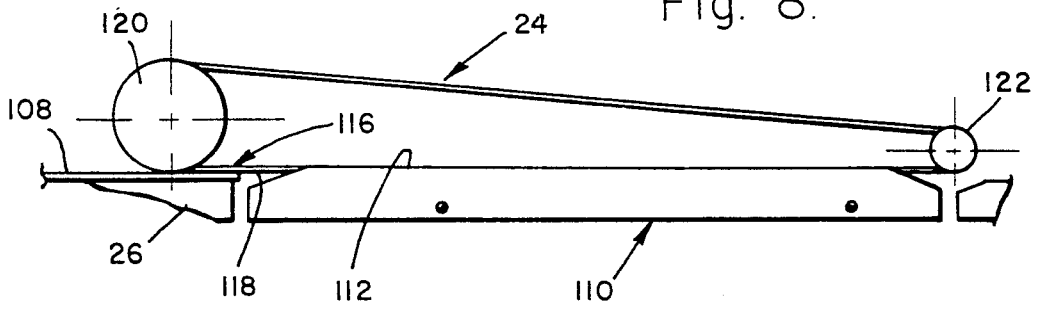
Fig. 10.
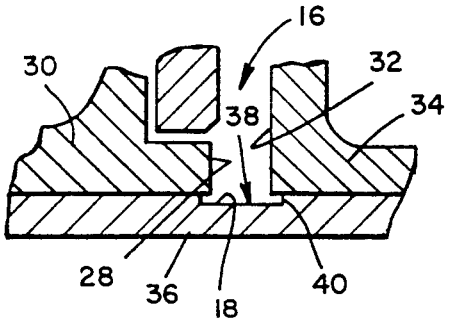
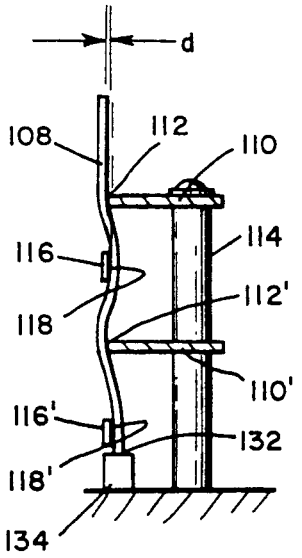
Fig. 9.
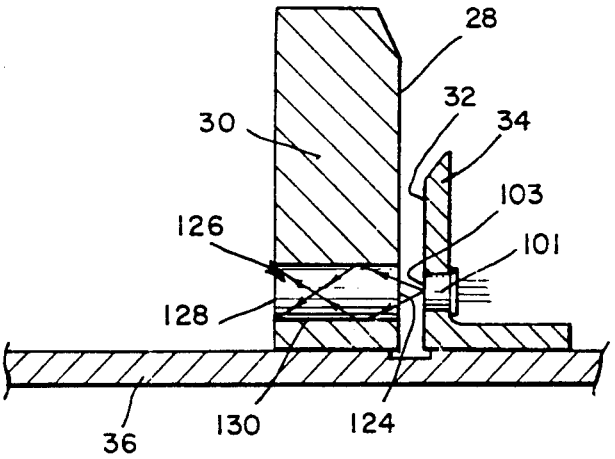
Fig. 11.
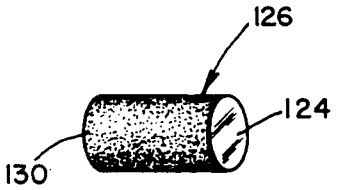
Fig. 12.

DOCUMENT TRANSPORT APPARATUS

CROSS REFERENCE TO RELATED APPLICATION

This application is a division of co-pending U.S. patent application Ser. No. 07/225,232, filed July 28, 1988, now U.S. Pat. No. 4,927,132, issued May 22, 1990.

BACKGROUND OF THE INVENTION

This invention relates to document transport apparatus, and more particularly to apparatus for loading manually or automatically fed documents into a document processing transport. A preloader transport for applying documents from a document feeder to a document loader is disclosed, as well as a novel track configuration along which upstanding sheets or documents may be advanced.

In certain document processing systems it is necessary to load documents into document transport apparatus such that the documents are aligned in precise manner to facilitate subsequent reading of information contained on the documents and/or printing of information onto, the documents. Such document loading apparatus, for example, is useful with transports for processing bank checks and merchant drafts, and for processing payments remitted by purchasers of goods and services.

In remittance processing systems, in particular, the loader device should be capable of rapidly and conveniently loading documents of various sizes and thicknesses, and of controllably aligning and advancing such documents into a main transport for processing. A typical transaction involved in remittance processing includes at least one check in payment of a customer bill or invoice along with a remittance coupon which is normally a returned portion of the invoice. Each of these documents contain machine readable data encoded thereon; the remittance coupon will normally include the customer's account number and the invoice amount, while the check will normally include the maker's bank and checking account numbers. The various functions performed by a remittance processing system may include the reading and storing of the machine readable data from both documents and/or the recording of video images of the documents including the machine readable data. From such data and other information obtained from the documents, the checks may be further imprinted with coded data representing the dollar amount of the check, the documents may be sorted, and various compilations of data may be prepared for further utilization.

Remittance processing systems include loader devices which permit documents to be vertically fed or hand-dropped by an operator into the loader, and which permit documents to be laterally fed into the loader by an automatic feeder apparatus. In either mode, the loader aligns or registers the bottom edge of the document along a registration surface of a track and then advances the document along the track. Such loaders permit the aligned document to be temporarily retained, or gated, prior to entering the system's main transport, by means for controllably blocking the loader's exit with a physical gate. When documents are automatically fed, further controllable means is normally provided by physically gating the document prior to its laterally entering the loader.

As the transports of remittance processing systems and automatic feeder apparatus increase in document throughput speed, the ability of prior art loaders to reliably keep pace becomes more difficult. Further, prior art loaders cannot generally accommodate documents of various thicknesses without adjustment being made to the loader, or documents of unusually narrow widths

SUMMARY OF THE INVENTION

The present invention provides apparatus for loading documents into a transport in precise and reliable manner. The apparatus accommodates high speed transports, documents of various thicknesses and documents of unusually narrow widths. The invention includes novel document gating means which permits controlled gating of a document with reliability and response time suitable for high speed transports. The loader of the present invention accommodates documents vertically dropped into the loader by an operator, as well as laterally fed documents issuing from an automatic feeder apparatus.

A feature of the present invention includes a preloader transport for applying documents to the loader issuing from the automatic feeder apparatus. A further aspect of the present invention includes a track configuration for supporting the bottom edge of an upstanding document in such manner as to decrease the likelihood of document distortion while the document is being advanced along the track. A still further feature of the apparatus of the present invention includes an improved light absorption device for combination with a reflective light sensor for sensing position of a document within the track.

Briefly described, the preferred document loader apparatus of the present invention includes document receiving means including a track having a registration surface for supporting each of the documents along their respective bottom edges; lateral entry means for enabling documents to be laterally fed thereinto and to be received by the document receiving means; vertical entry means for enabling an operator to manually drop documents into the receiving means; a plurality of rotatable disks having respective planar surfaces perpendicular to the track's registration surface and in side-by-side spaced relation along the track; means for rotating the disks and the disk surfaces; a plurality of first force-applying members such as wheels, each actuable between an active position and an inactive position and having actuation means therefor, the first wheels when in their active positions resiliently engage their respectively associated disks for urging a received document against respectively associated ones of the rotating disk surfaces when the received document is interposed therebetween for causing the document to advance toward and register its bottom edge against the track's registration surface; a plurality of second wheels, each actuable between an active position and an inactive position and having actuation means therefor, the second wheels when in their active positions resiliently engage their respectively associated disks for urging the received document against respectively associated ones of the rotating disk surfaces when the received document is interposed therebetween for causing the document to advance along the track; first control means for controlling actuation of the first and second wheels to their active and inactive positions respectively, and alternatively to their inactive and active positions respectively The second wheels are preferably aligned, with respect to the disks, such that when in their active positions the second wheels urge the received interposed document against the respectively associated ones of the rotating disk surfaces such that the document's bottom edge is urged toward the track's registration surface while the document is being advanced along the track.

The lateral entry means includes a portion of the track with a portion of its registration surface; at least one (and preferably two) additional rotatable disks having respective planar surfaces perpendicular to the registration surface and in side-by-side spaced relation along such track portion and with the planar surfaces of the plurality of spaced rotatable spaced disks; means for rotating the additional rotatable disks and their planar surfaces; at least one third wheel respectively associated with the at least one additional disk, each third wheel actuable between an active position and an inactive position and having actuation means therefor, the third wheels when in their active positions resiliently engage their respectively associated disks for urging the laterally fed document against respectively associated ones of the additional rotating disk surfaces when the fed document is interposed therebetween for causing the interposed document to gate while advancing toward and registering at least a portion of its bottom edge against the registration surface of the track portion; at least one fourth wheel respectively associated with the at least one additional disk, each fourth wheel actuable between an active and an inactive position and including actuation means therefor, the fourth wheels when in their active positions resiliently engage their respectively associated disks for urging a laterally fed document against respectively associated ones of the additional rotating disk surfaces when the fed document is interposed therebetween for advancing the document along the track portion to the document receiving means; and second control means for controlling actuation of the third and fourth wheels to their active and inactive positions respectively, and alternatively to their inactive and active positions respectively.

The second control means is responsive to sensor means which senses when the laterally fed document has entered the lateral entry means, and is further subject to other software commands, for controlling actuation of the fourth wheels from their active to their inactive positions and the third wheels from their inactive to their active positions, for gating the laterally fed document. When the document receiving means is ready to receive the gated laterally fed document, the second control means is responsive for actuating the fourth wheels from their inactive to their active positions and the third wheels from their active to their inactive positions, for advancing the document along the track and to enter the document receiving means. The second wheels, which are in their active positions, urge the laterally received document against the plurality of rotating disk surfaces of the receiving means, for advancing the document along the track.

When documents are being vertically dropped into the document receiving means, the first wheels are in their active positions and the second wheels are in their inactive positions, so that the document's bottom edge advances toward and registers against the track's registration surface. The first control means is responsive to sensor means, for initiating forward advancement of the registered document along the track, by controlling actuation of the first wheels from their active to their inactive position and the second wheels from their inactive to their active position.

Regardless of whether the document is vertically or laterally received by the document receiving means, the first control moons is responsive to sensor means, which senses when a received document has advanced along the track to the last of the disks of the plurality of spaced disks within the document receiving means, and is further subject to other software commands, for gating the received document as well as for assuring its horizontal registration prior to entering the main transport, by controlling actuation of the second wheels from their active to their inactive positions and the first wheels from their inactive to their active positions. When the gated document is to exit the document receiving means and enter the main transport, the first control means is responsive for actuating the second wheels from their inactive to their active positions and the first wheels from their active to their inactive positions.

When documents are to be laterally fed into the loader, a preloader transport applies documents issuing from the automatic feeding apparatus to the loader's lateral entry means. The preloader transport slippedly supports a portion of the document when the document is gated at the lateral entry means, i.e. when the document is urged against the additional rotating disk surfaces by the third wheels. The preloader transport comprises a first plate member having a document engaging edge along a transport path, for engaging the document on one side thereof; a second plate member having a document engaging edge along the transport path, for engaging the document on the same side as does the first plate member edge; a first drive belt having a document engaging surface along the transport path, for engaging the document on the document's other side; and a second drive belt having a document engaging surface along the transport path, for engaging the document on the same side as does the first drive belt. The plate members and the belts are situated with the first plate member edge, the first belt surface, the second plate member edge and the second belt surface arranged in successive vertically spaced relation and such that the belts urge the sheet against the plate member edges when the sheet is engaged by the belt surfaces and the plate member edges. The preloader transport further includes means for driving the belts along the transport path, and the document is fed into the transport path such that the one side of the document is engaged by the plate member edges and the other side of the document is engaged by the belt surfaces. The belts are preferably of elastic material for ease of adjustment and for uniformity of drive with documents of various thicknesses.

In the preferred embodiment of the loader apparatus according to the present invention, the track includes two spaced-apart upstanding walls obverse one another with a floor therebetween for supporting the document along the document's bottom edge, each wall having a groove along its bottom, the two grooves undercutting the walls such that the walls overhang the floor.

The improved light sensor device, for use in the preferred embodiment of the loader apparatus according to the present invention, comprises light emitting and sensing means in one of the track's two spaced-apart walls, for emitting light energy and sensing the light energy reflected back from a sheet or document interposed between the walls and in the path of the emitted light energy; and light absorbing means in the other wall for absorbing the light energy emitted from the light emitting and sensing means when the sheet or document is not interposed between the light emitting and sensing means and the light absorbing means, the light absorbing means including a transparent cylindrical member having a polished end surface for receiving the emitted light energy, the cylinder's other end surface and the cylinder's cylindrical surface being light energy absorbent.

BRIEF DESCRIPTION OF THE DRAWINGS

The novel features which are believed to be characteristic of the invention, together with further aspects and advantages thereof, will be better understood from the following description considered in connection with the accompanying drawings in which preferred embodiments of various aspects of the invention are illustrated by way of example. It is to be expressly understood, however, that the drawings are for the purpose of illustration and description only and are not intended as a definition of the limits of the invention.

FIG. 8 is a plan view of the preloader transport shown in FIG. 1;

FIG. 9 is a side elevation view of the preloader transport of FIGS. 1 and 8, taken along the line 9—9 of FIG. 1 in the direction of the appended arrows, with an included document shown in exaggerated profile;

FIG. 10 is a side sectional view of a fragment of the loader apparatus of the present invention, as in FIG. 3, showing an enlarged detail a preferred track configuration according to one aspect of the present invention;

FIG. 11 is a side sectional view of a preferred improved light sensor arrangement according to an aspect of the present invention; and FIG. 12 is a perspective view of the light absorption portion of the light sensor arrangement shown in FIG. 11.

DESCRIPTION OF THE PREFERRED EMBODIMENTS

Figure 1:
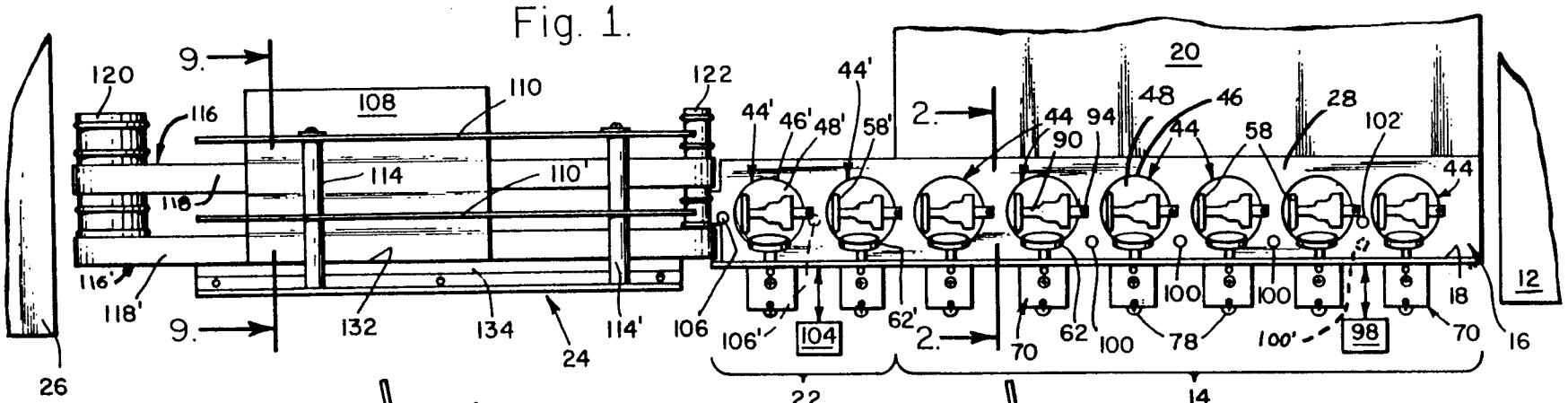
FIG. 1 is an elevation view of a document loader and preloader apparatus according to a preferred embodiment of the present invention.

Turning first to FIG. 1, there is shown a preferred embodiment of document loading apparatus 10 according to the present invention, for loading documents into a main transport of a document processing system 12. As used herein, a "document" refers to a generally rectangular sheet of paper or other flexible sheet usually containing information thereon, and further includes an envelope or carrier containing one or more of such sheets and usually having a transparent window for viewing the sheets contained therein.

The loading apparatus 10 includes a document receiving section 14 including a track 16 having a horizontally extending registration surface 18 (see also FIGS. 2 and 3) for supporting upstanding documents along their respective bottom edges. A vertical entry section or drop guide 20 permits an operator to manually vertically enter or drop documents into the document receiving section 14. A lateral entry section 22 enables documents to be laterally fed into the receiving section 14 from a preloader transport 24, which laterally transports upstanding documents issuing from automatic document feeder apparatus 26. An example of an automatic document feeder apparatus is described in U.S. Pat. No. 4,723,773 incorporated herein by reference.

The track 16 includes an upstanding support wall 28 of a support block 30, spaced from and facing an included upstanding guide wall 32 of a guide plate 34, the track 16 including a floor 18 (i.e. the track's registration surface 18) along a bottom plate 36 and between the two upstanding walls 28, 32. Preferably, the floor or registration surface 18 is formed along a longitudinal channel 38 undercutting the two upstanding walls 28, 32 such that the walls 28, 32 overhang the floor 18 by a distance equal to the depth of the channel 38, as more clearly shown in FIG. 10. The walls 28, 32 alternatively may be considered as each having a groove 40 along their respective bottom edges, the two grooves 40 undercutting the walls 28, 32 such that the walls 28, 32 overhang the floor 18 by a distance equal to the width (i.e. the vertical dimension) of the groove 40. An example of such distance is 0.015 inch, while the depth of the groove 40 may also be 0.015 inch. Without the undercut configuration of the track 16, the leading bottom corner of the advancing document 44 would tend to curl or wedge, and such curling or wedging is precluded by interference from the overhanging bottom edges of the walls 28, 32 when the document 44 is advancing along the registration surface 18 The result is a decreased likelihood of document jams both during loading and after the document has entered the main transport 12.

Advancement of each document for registration of the document's bottom edge along the preferably horizontally extending registration surface 18, for transporting the registered document along the track 16 for entering the document processing main transport 12, and for temporarily retaining or gating the document at specific locations along the track 16, are accomplished by means of controlled operation of a series of document driver devices 44, 44' spaced along the track 16.

Figure 2:
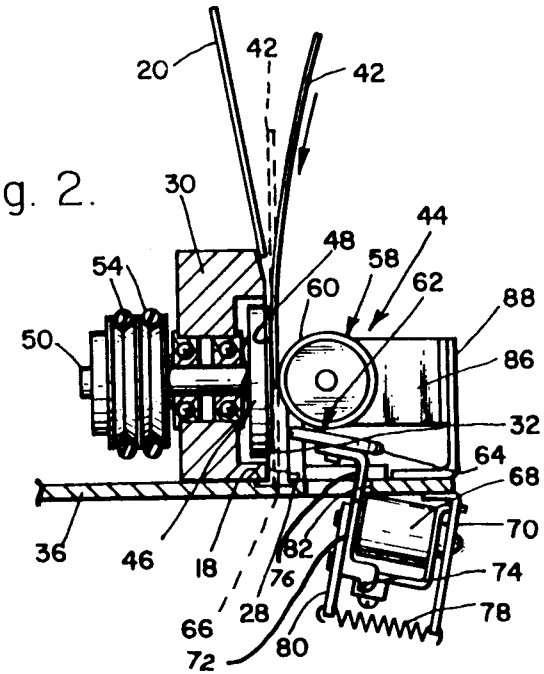
FIG. 2 is a side sectional view of a document driver device shown in FIG. 1, taken along the line 2—2 in the direction of the appended arrows, indicating both manual loading and gating of a document.

Referring to FIGS. 1 and 2, each driver device 44 includes a rotatable disk 46 having a planar surface 48 which rotates with rotation of the disk 46. Each disk is rotatably mounted in the support block 30, with the rotatable disk planar surface 48 parallel to and protruding from the vertical support wall 28. A plurality of such disks 46 are arranged in side-by-side spaced relation along the track 16 within the document receiving section 14, with their planar surfaces 48 perpendicular to the track's registration surface 18.

At least one, and preferably two, additional document driver devices 44' are situated within the lateral entry section 22 of the loading apparatus 10. Each additional driver device 44' includes a rotatable disk 46' having a rotatable planar surface 48', and the additional disks 46' are rotatably mounted in the support block 30 with their respective planar disk surfaces 48' parallel to and protruding from the support wall 28. The two additional rotatable disks 46' are arranged with their planar surfaces 48' perpendicular to the track's registration surface 18 and in side-by-side spaced relation along a portion of the track 16 and with the planar surfaces 48 of the spaced disks 48 within the receiving section 14.

Figure 6:
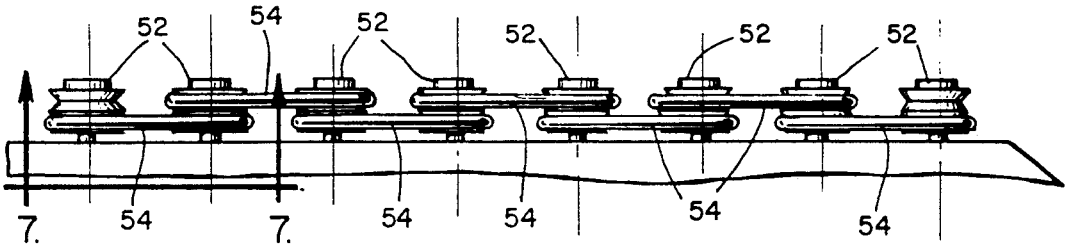
FIG. 6 is a plan view of a fragment of the loader apparatus of FIG. 1, indicating means for rotating the spaced rotatable disks of FIG. 1.
Figure 7:
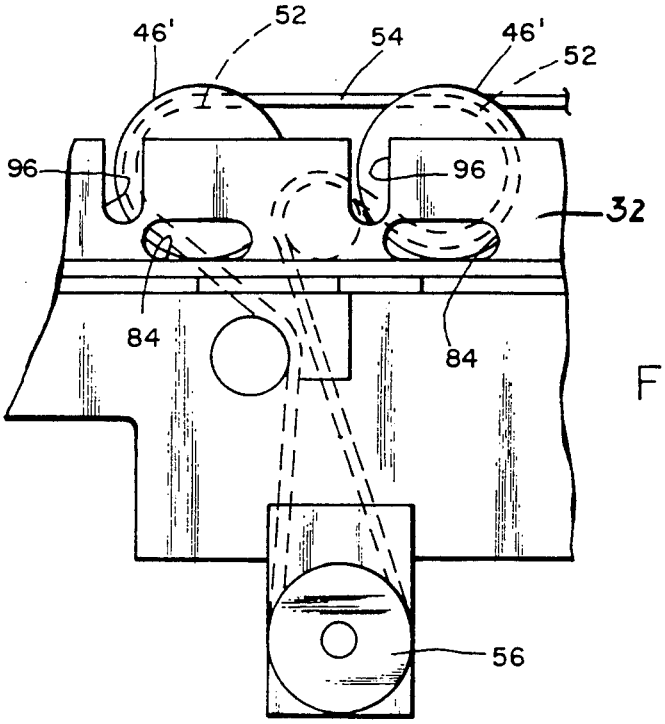
FIG. 7 is a fragment of the drive means of FIG. 6, taken along the line 7—7 in the direction of the appended arrows.

The disks 46, 46' and their disk surfaces 48, 48' are rotatable in a counterclockwise direction and preferably at the same speed, and rotational drive means are provided therefor. For example, a shaft 50 connected perpendicularly to the center of the disk 46 along the disk's axis of rotation is rotatably mounted in the support block 30. As shown in FIGS. 6 and 7, each of the shafts 50 respectively connected to the disks 46, 46' may be caused to rotate counterclockwise by such conventional means as a pulley 52 attached to each of the shafts 50 and driven by drive belts 54 which in turn are driven by a motor drive means 56.

Returning to FIGS. 1 and 2, associated with each of the disks 46 are respective first wheels 58, each preferably including a tire 60 of rubber or other elastomer material, mounted for applying pressure to the disk surfaces 48 at a position such that a document interposed between a disk surface 48 and its associated first wheel 58 will cause the rotating disk surface 48 to advance the document in a downward direction toward the track's registration surface 18. In the embodiment shown, the first wheels 58 are substantially vertically oriented with respect to the horizontally extending registration surface 18, and may be actuated to apply pressure to a location on the counterclockwise rotating disk surfaces 48 where the surfaces 48 are moving in a substantially downward direction, commonly referred to as the 9:00 o'clock position, and at substantially the same speed.

Figure 5:
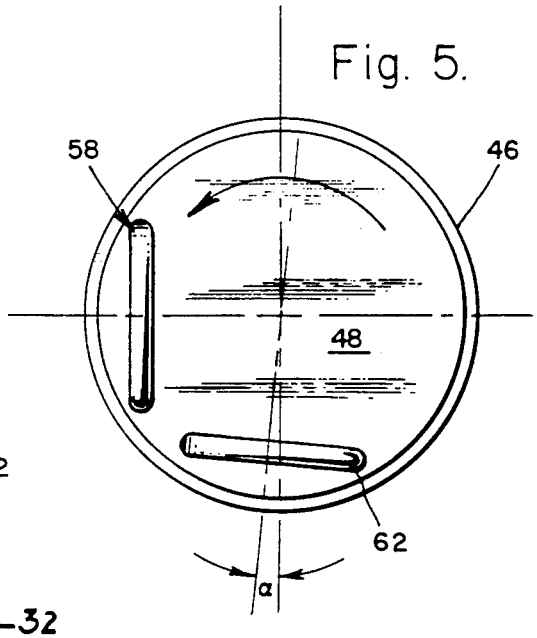
FIG. 5 .s a diagramatic front elevation view of the document drive members of FIGS. 2 and 3.

Associated with each of the disks 46 are respective second wheels 62, each preferably including a tire 64 of rubber or other elastomer material, mounted for applying pressure to the disk surfaces 48 at a position such that a document interposed between a disk surface 48 and its associated second wheel 62 will cause the rotating disk surface 48 to advance the document in a lateral or horizontal direction toward the document processing main transport 12. In the preferred embodiment, the second wheels 62 are slightly skewed at an angle $\alpha$ as shown in FIG. 5, and may be actuated to apply pressure to a location on the counterclockwise rotating disk surfaces 48 where the surfaces 48 are moving at substantially the same speed in a substantially forward (i e. horizontally toward the main transport 12) and slightly downward direction. The second wheels 62 will accordingly engage their respective counterclockwise rotating disk surfaces 48 at a location which may be described as the 6:00 o'clock position plus the rotational angle $\alpha$. In one suitable example, the skew angle $\alpha$ is $1\frac{1}{2}°$.

Associated with each of the additional disks 46' are third wheels 58', which are similar to the first wheels 58 both in construction and in their mounting relationship with respect to their associated disk surfaces 48'. Further associated with each of the additional disks 46' are fourth wheels 62', which are similar to the second wheels 62 both in construction and in their mounting relationship with respect to their associated disk surfaces 48'.

The disk surfaces 48, 48' are provided with a friction surface, which may be produced by roughening the surfaces 48, 48' by glass bead blasting followed by hard anodizing, for applying drive friction onto the back side of a document interposed between a rotating disk surface 48, 48' and an associated pressure wheel 58, 62, 58', 62' when in its active position.

Figure 3:
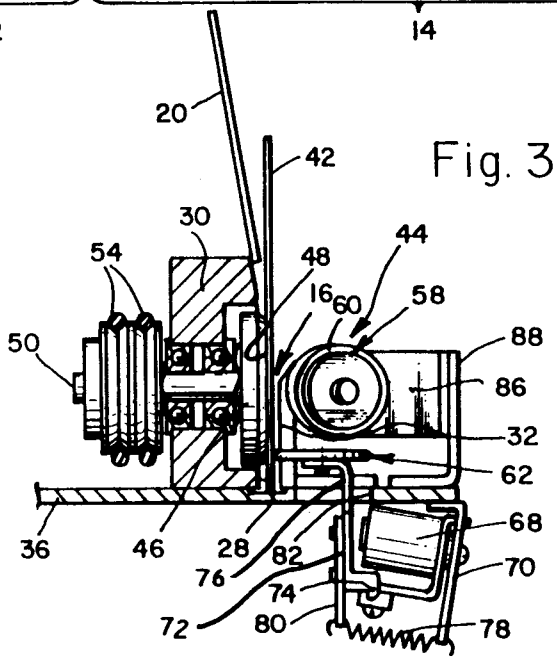
FIG. 3 is a side sectional view similar to FIG. 2, indicating lateral advancement of a document.

Each of the first wheels 58 and each of the second wheels 62 is actuable between an active position and an inactive position In FIG. 2 there is shown a first wheel 58 in its active position resiliently engaging its associated disk 46 for urging a document 42, interposed between the first wheel 58 and its associated disk surface 48, against the rotating disk surface 48, causing the interposed document 42 to advance toward and register its bottom edge 66 against the track's registration surface 18. Also shown in FIG. 2 is a second wheel 62 in its inactive position, i.e. retracted from the track 16 so that the second wheel 62 is not in engagement with its associated disk 46 nor in contact with an interposed document 42. In FIG. 3 there is shown the first wheel 58 in its inactive position, i.e. retracted from the track 16 so that it does not engage its associated disk 46 nor does it contact an interposed document 42. Also shown in FIG. 3 is a second wheel 62 in its active position resiliently engaging its associated disk 46 such that an interposed document 42 is urged against the rotating disk surface 48 for causing the document to advance along the track 16.

The actuation means for a second wheel 62 includes a solenoid 68 which is mounted to the bottom plate 36 by means of a bracket 70, and having an armature 72 which is pivotally coupled to the bracket 70 by a pivot pin 74. The second wheel 62 is rotatably mounted to an upper extention 76 of the armature 72, so that when the solenoid 68 is in its energized condition to magnetically attract the armature 72, the extended armature 72 is pivoted and the second wheel 62 is in its inactive position shown in FIG. 2. At the same time, the pivoting of the extended armature 72 causes further biasing of a spring 78 connecting the free end of a lower extention 80 of the armature 72 (the lower extention 80 extending below the pivot pin 74) and the mounting bracket 70. When the solenoid 68 is in its deenergized condition, the armature 72 :s released therefrom and is caused to pivot about the pivot pin 74 as the extended armature 72, acted upon by the biased spring 78, pivots the second wheel 62 to its active position shown in FIG. 3. Movement of the second wheels 62 between their two positions is facilitated by the extended armatures 72 extending through respective apertures 82 in the bottom plate 36 (see FIG. 3) and by apertures 84 in the support wall 32 (see FIG. 7) for permitting passage of the engaging portion of the respective second wheels 62 into the track 16.

Figure 4:
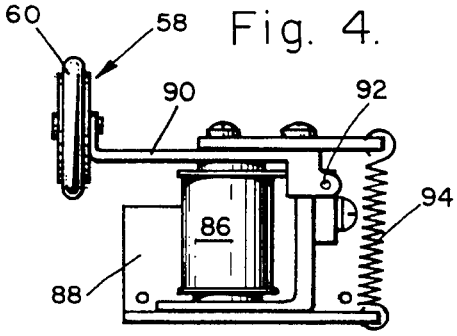
FIG. 4 is a plan view of the upper wheel arrangement shown in FIGS. 2 and 3.

Similarly, the actuation means for the first wheel 58 includes a solenoid 86 which is mounted to the bottom plate by means of a bracket 88, and having an extended armature 90 which is pivotally coupled to the bracket 88 by a pivot pin 92 (see also FIG. 4). The first wheel 58 is rotatably mounted to one end of the extended armature 90, so that when the solenoid 86 is in its energized condition to magnetically attract the armature 90, the extended armature 90 is pivoted and the first wheel 58 is in its inactive position shown in FIGS. 3 and 4. At the same time, the pivoting of the extended armature 90 causes further biasing of a spring 94 connecting the free end of the extended armature 90 and the bracket 88. When the solenoid 86 is in its deenergized condition, the armature 90 is released therefrom and is caused to pivot about the pivot pin 92 as the extended armature 90, acted upon by the biased spring 94, pivots the first wheel 58 to its active position shown in FIG. 2. Movement of the first wheels 58 between their two positions is facilitated by openings or vertically extending slots 96 in the guide wall 32 (see FIG. 7) for permitting passage of the engaging portion of the first wheels 58 into the track 16.

Each of the third wheels 58' is actuable between active and inactive positions similarly to the first wheels 58, and each of the fourth wheels 62' is actuable between active and inactive positions similarly to the second wheels 62. The actuation means for a third wheel 58' is provided by a solenoid, extended pivoted armature and spring arrangement similar to the solenoid 86, extended pivoted armature 90 and spring 94 arrangement for a first wheel 58 both in construction and in manner of operation as previously described. The actuation means for a fourth wheel 62' is provided by a solenoid, extended pivoted armature and spring arrangement similar to the solenoid 68, extended pivoted armature 72 and spring 78 arrangement for a second wheel 62 both in construction and in manner of operation as previously described.

Of course, a wheel will rotate when in direct contact with a rotating disk or with a document which is being advanced by a rotating disk.

A feature of the present invention is the ability of the document driver devices 44, 44' to automatically accommodate documents of various thicknesses. This feature results from the use of the two springs 78, 94 and their respective pivotally mounted armatures 73, 90, in each of the document driver devices 44, and in each of the document driver devices 44'. The drive pressure or force applied by a first wheel 58 (or a third wheel 58') for urging a document against an associated rotating disk surface 48 or 48' for downwardly driving a document, is provided by the associated spring 94 and is substantially the same regardless of document thickness. Similarly, the drive pressure or force applied by a second wheel 62 (or a fourth wheel 62') for urging a document against an associated disk surface 48 or 48' for driving a document in the forward direction, is provided by the associated spring 78 and is substantially the same regardless of document thickness. The force applied by a pressure wheel 58, 62, 58' or 62' when engaging its associated disk 46 or 46' is preferably approximately 3 ounces, and is within a preferred range of approximately 2½ to 4 ounces.

Further, each wheel 58, 62, 58' or 62' and its associated actuation means (e.g. wheel 62, solenoid 68, pivotally mounted armature 72 and connected spring 78) is a low inertia device capable of fast response times for actuating its associated wheel between positions.

First control means 98 is provided for controlling actuation of all of the upper first wheels 58 and all of the lower second wheels 62 (of the plurality of document driver devices 44 within the document receiving section 14) to their active and inactive positions respectively, and alternatively to the inactive and active positions respectively. The first control means 98 controls energization and deenergization of all of the solenoids 94 associated with the upper first wheels 58 and all of the solenoids 68 associated with the lower second wheels 62, for simultaneously energizing all of the solenoids 94 associated with the first wheels 58 to place all of the first wheels 58 in their inactive positions, while simultaneously deenergizing all of the solenoids 68 associated with the second wheels 62 to place all of the second wheels 62 in their active positions. The first control means 98, alternatively, controls simultaneous deenergization of all of the solenoids 94 associated with the first wheels 58 for placing all of the first wheels 58 in their active positions, while controlling simultaneous energization of all of the solenoids 68 associated with the second wheels 62 to place all of the second wheels 62 in their inactive positions. The first control means 98 is responsive to downward and forward advancement of a document within, the document receiving section 14 as sensed by light sensor devices 100, 102, which will be more fully described later, and is further responsive to additional software commands in accordance with other factors such as those associated with the document processing main transport 12.

Second control means 104 is provided for controlling actuation of all of the third wheels 58' and all of the fourth wheels 62' (of the additional document driver devices 44' within the lateral entry section 22) to their active and inactive positions respectively, and alternatively to their inactive and active positions respectively. The second control means 104 controls energization and deenergization of all of the solenoids associated with the third wheels 58' and to all of the solenoids associated with the fourth wheels 62', for simultaneously energizing both (in the case of the preferred embodiment shown in FIG. 1) of the solenoids associated with the third wheels 58' to place both of the third wheels 58' in their inactive positions, while simultaneously deenergizing both of the solenoids associated with the fourth wheels 62' to place both of the fourth wheels 62' in their active positions. The second control means, alternatively, controls deenergization of both of the solenoids associated with the third wheels 58' to place both of the third wheels 58' in their active positions, while controlling simultaneous energization of both of the solenoids associated with the fourth wheels 62' to place both of the fourth wheels 62' in their inactive positions. The second control means 104 is responsive to a document's entering the lateral entry means 22 as sensed by light sensor device 106, which will be more fully described later, and is further responsive to forward advancement of the document within the document receiving section 14 and to further software commands in accordance with other factors such as those associated with functions of the document processing main transport 12.

Turning to FIGS. 1, 8 and 9, the preloader transport 24 receives laterally fed documents 108 from the automatic document feeder apparatus 26 which may be of the type described in the aforementioned U.S. Pat. No. 4,323,773, and laterally transports the upstanding documents 108 to the lateral entry section 22 of the loader 10. The preloader transport 24 includes a first plate member 110, which may be a rigid strip, having a low friction edge 112 extending along the document path for engaging one side of the upstanding laterally fed document 108, and a second plate member 110', such as a second rigid strip, having a low friction edge 112' extending along the document path for engaging the same side of the upstanding laterally fed document 108. The plate members 110, 110' are supported with their document engaging edges 112, 112' along the document path, one above the other, by support means such as support posts 114, 114'.

A first endless drive belt 116, having a document engaging flat surface 118 along the document path for engaging the other side of the upstanding laterally fed document 108, is driven along the document path by drive means such as a vertically upstanding motor-driven roller 118 and a vertically upstanding idler roller 120. A second endless drive belt 116', having a document engaging flat surface 118' along the document path for engaging such other side of the document 108, is similarly driven along the document path by the driven roller 118 and the idler roller 120.

The plate members 110, 110' and the drive belts 116, 116' are arranged with the first plate member edge 112, the first belt document engaging surface 118, the second plate member edge 112' and the second belt document engaging surface 118' in successive vertically spaced relation (preferably with the first plate member edge 112 uppermost, as shown in FIGS. 1 and 9) along the document path. As indicated in FIG. 9, the plate member edges 112, 112' extend slightly past the belt surfaces 118, 118', in the horizontal direction, by a distance d (for example 0.02 inch), such that the belts 116, 116' urge the document 108 against the plate member edges 112, 112' when the document 108 is engaged by the belt surfaces 118, 118' and the plate member edges 112, 112', and the document 108 will assume a profile of the type exaggeratedly shown in FIG. 9. The belts 116, 116' are preferably of elastic material, and are unsupported along the document transport path (i.e. the belts 116, 116' are not back-supported along their respective document engaging segments), for ease of adjusting the relative positions of the belts 116, 116' and plate members 110, 110', and for permitting the belts 116, 116' to uniformly drive documents of various thicknesses.

The document loader apparatus 10 of the present invention operates in either of two modes—i.e., manual vertically fed or "hand-drop" mode, and automatic laterally fed or "autofeed" mode. The disks 46, 46' and their respective disk surfaces 48, 48' are rotatably driven continuously in a counterclockwise direction during both modes of operation.

During the hand-drop mode, the upper first wheels 58 within the document receiving section 14 are initially in their active positions resiliently engaging their respective disk surfaces 48, while the lower second wheels 62 are in their inactive positions retracted from their respective disk surfaces 48, as shown in FIG. 2. As the document 42 is dropped into the vertical entry section 20, it will enter the document receiving section 14 and become interposed between at least two disk surfaces 48 and their associated engaged upper first wheels 58. The pressure applied by the upper wheels 58 (derived from their respective springs 94) will cause the counterclockwise rotating disk surfaces 48 to drive the document 42 downwardly within the track 16 toward the registration surface 18. As the document's bottom edge 66 advances toward the registration surface 18, the document 42 will trigger at least one of the three light sensor devices 100 arranged in spaced relation along and slightly above the registration surface 18.

It is preferred that each light sensor device 100 include a reflective sensor 101 which provides both light emitting and sensing means, which is secured in the guide plate 34 as shown in FIG. 11. Each reflective sensor 101 has a flat face 103 mounted flush with the guide wall 32, permitting self cleaning of the sensor's face 103 by the advancing documents. The sensor 101 "looks into" a polished end 124 of a transparent cylindrical member 126 which is preferably made of acrylic such as sold under the trademark Lucite. The other end 128 and the cylindrical surface 132 of the transparent cylinder 124 are blackened so as to be light absorbent; for example, the surfaces 128, 132 may be roughened and then printed flat black to provide a matte finish. The cylinder 126 is secured in the support block 30 with its longitudinal axis perpendicular to the face of the reflective sensor 101. The cylinder's transparent polished end surface 124 is flush with the support wall 28, providing a continuous support wall 28 in the vicinity of the light receiving face 124, thereby precluding these end surfaces 124 from being a source of document jams. In situations where the support wall 28 :s not parallel to the face 103 of the reflective sensor 101, the transparent polished end 124 of the cylinder 126 need not be perpendicular to the longitudinal axis of the cylinder 126 but will instead conform to the support wall 28.

The reflective sensor 101 emits light which enters the light receiving cylinder 126 through the polished end 124 when a document is not interposed between the sensor 101 and the cylinder end 124. The light received by the cylinder 126 is scattered and finally absorbed by the blackened cylindrical surface 130 and the blackened end 128. When a document is interposed between the reflective light sensor 101 and the cylinder's polished end 124, the light energy is reflected back from the interposed document (which normally has a reflective surface and is usually opaque) and sensed by the sensor 101. The light absorbing cylinder 126 provided by this aspect of the present invention increases the reliability of the sensor 101 by providing a highly efficient means for absorbing emitted light and minimizing the light reflections in the absence of an interposed document.

Returning to the operation of the loader 10 during the hand-drop mode, the upper first wheels 58 will remain in their active positions until any one of the three registration sensor devices 100 is blocked by an interposed document 42. Upon such occurrence, the first control means 98 will control energization of the solenoids 86 of the upper first wheels 58, and deenergization of the solenoids 68 of the lower second wheels 62, with a suitable decaying response time (for example approximately 1/64th second) for permitting continued downward driving such that the document's bottom edge 66 will be registered against the track's registration surface 18, and for assuring horizontal registration even of documents that are manually dropped into the receiving section 14 at an angle. The upper first wheels 58 retract to their inactive positions while the lower second wheels 62 engage to their active positions, as shown in FIG. 3. The pressure exerted by the lower wheels 62 upon the registered document 42 and to the counterclockwise rotating disk surfaces 48, through action of the springs 78, causes the engaged rotating disk surfaces 48 to advance the document along the track 16 toward the main transport 12. The $1\frac{1}{2}°$ skew of the lower wheels 62 assure that the document's bottom edge 66 remains in horizontal registration with the registration surface 18 as the document 42 is transported along the track 16.

When the leading edge of tho forward advancing document 42 passes the exit sensor device 102 (which is similar to the sensor device 100 previously described) located within the track 16 just before the last disk 46 and at a height distant from the registration surface 18, the document 42 reflects the sensor emitted light into the reflective light sensor included in exit sensor device 102. The first control means 98 responds by controlling deenergization and energization of the solenoids 86, 68, respectively, for causing the upper first wheels 58 to assume their active positions and the lower second wheels 62 to assume their inactive positions, following a response time which permits the document 42 to be engaged by the last document driver device 44 of the plurality of such devices. The pressure exerted by the upper first wheels 58 in contact with the document 42 causes the associated disk surfaces 48 to urge the document 42 downwardly against the registration surface 18 while slipping against the document's back side, gating the document 42 prior to its exiting the document receiving section 14. When the main transport 12 is ready for the gated document, the first control means 98 controls the upper first wheels 58 to retract and the lower second wheels 62 to engage, applying pressure to the engaged rotating disk surfaces 48 which forwardly drive the document 42 into the main transport 12.

When entering the main transport 12, it is not uncommon for the document 42 to be initially driven by the main transport 12 at a slower speed than the speed by which the document is being driven by the loader 10. For example, an OCR reader or a video camera may be located at the beginning of the main transport 12, close to the exit of the loader 10. The loader 10 may be driving the document 42 into the OCR reader nip or the video camera nip at say 100 inches per second while the reader or camera nip is driving the document say 20 inches per second. The rotating disk surfaces 48, which are in forward driving engagement with the document 42, slip against the document's backside as the document's forward speed is being restricted by the speed of the reader or camera nip at the entrance of the main transport 12, so that the document 42 is actually being driven at a speed of 20 inches per second. At the same time, the downward urging provided by the skew of the lower wheels 62 continues registration during the forward advancement of the document by the reader or camera nip, by preventing upward movement of the document's trailing edge.

During the autofeed mode of operation of the loader 10, the lower second wheels 62 within the document receiving section 14 and the additional lower fourth wheels 62' within the lateral entry section 22 ore normally in their active positions resiliently engaging their respective disk surfaces 48, 48' while the upper first wheels 58 and the upper third wheels 58' are normally in their inactive positions retracted from their respective disk surfaces 48, 48', as shown in FIG. 3. Referring to FIGS. 1, 8 and 9, the automatic lateral feeding device or "autofeeder" 26 ejects a document 108 into the preloader transport 24, with the document's back side engaging the drive belt surface 118, 118' and the document's front side engaging the plate edges 112, 112'. The bottom edge of the document 108 will generally ride upon, or at least be no lower than, a horizontal surface 132 Of a preloader track 134, which surface 132 is preferably slightly higher than the registration surface 18. The drive belts 116, 116' are continuously driven during autofeed mode, and the laterally fed document 108 conforms in the manner previously described in connection with FIG. 9 as it is laterally transported by the preloader transport 24 to the lateral entry section 22 of the loader 10.

When the locating edge of the laterally fed document 108 passes the entrance sensor device 106 (which is similar to the sensor device 100 previously described) located within the track 16 at the entrance of the lateral entry section 22 before the first of the additional disks 46' and at a height distant from the registration surface 18, the document 108 reflects the entrance sensor emitted light into the reflective light sensor included in the entrance sensor device 106. The second control means 104 responds by controlling deenergization and energization of the solenoids associated with the upper their wheels 58' and the lower fourth wheels 62', respectively, for causing the upper third wheels 58' to assume their active positions and the lower second wheels 62' to assume their inactive positions, following a suitable decaying response time (for example approximately 1/64th second) for permitting the document 108 to be engaged by the two driver devices 44' within the lateral entry section 22. The pressure exerted by the upper third wheels 58' in contact with at least the forward portion of the document 108 causes the associated disk surfaces 48' to gate the document 108 for preventing its entry into the document receiving section 14 while advancing the engaged portion of the document 108 downwardly toward the portion of the registration surface 18 within the lateral entry section 22. The rotating disk surfaces 48' continue to urge the engaged portion of the document 108 downwardly against the registration surface 18 while slipping against the document's back side. If the width of the document 108 is such that a portion of the document 108 remains in the preloader transport while the document is gated at the lateral entry section 22, the driven belt surfaces 118, 118' slip against the document's back side so that the preloader engaged portion of the gated document 108 remains supported as shown exaggerately in FIG. 9.

When the document receiving section 14 is ready to receive the gated document 108 (for example, in response to the preceding document's having fully entered the main transport 12 as sensed by the unblocking of the exit sensor device 102), the second control means 104 controls retraction of the upper third wheels 58' and engagement of the lower fourth wheels 62' for forwardly advancing the document 108 into the document receiving section 14 and into engagement with the rotating disk surfaces 48 and the active lower second wheels 62. As the document 108 forwardly advances, the $1\frac{1}{2}°$ skew of the lower wheels 62, 62' further horizontally registers the bottom edge of the document 108 against the registration surface 18.

When the leading edge of the forwardly advancing document 108 passes the exit sensor device 102, the document 108 is gated in the manner previously described with respect to gating of the vertically dropped document 42. This gating of a document prior to its entering the main transport 12 serves a second important purpose, particularly in the case of laterally fed documents 108, of horizontally registering the document of all of the previous registration procedures were insufficient to provide adequate registration.

As further assurance that adequate horizontal registration has been effected prior to a document's entering the main transport 12, the first control means 98 is responsive to the condition where no one of the registration sensor devices 100 is triggered (i.e. registration is not effected) while the more vertically situated exit sensor device 102 is triggered (i.e. a document is laterally positioned to exit the receiving section 14), for gating the document or for continuing the gating of the document—and the consequent downward advancement of the document—until one of the registration sensor devices 100 is triggered by being blocked by the interposed document.

Although the loader 10 is shown in FIG. 1 as including an upper or first wheel 58 associated with each of the rotating disks 46 within the document receiving section 14, the upper or first wheel 58 shown with the first disk 46 (i.e. the disk 46 farthest to the left within the document receiving section 14 as viewed in FIG. 1) is not necessary and may be omitted In actual practice, documents are rarely if ever manually dropped into the receiving section 14 such that a portion of the document would be interposed between this first rotating disk 46 and an associated upper first wheel 58 if present.

During the hand-drop mode, it is preferred that the document be engaged simultaneously by at least two rotating disk surfaces 48 and their respective active upper first wheels 58 during the document's downward advancement. For laterally fed documents it is preferred that the document be engaged simultaneously by both additional rotating disk surfaces 48' and both active upper third wheels 58', when gating. Similarly, it is preferred that a document be engaged simultaneously by at least the last two rotating disk surfaces 48 in the document receiving section 14, and their respective active upper first wheels 58, when gating.

It is further preferred that a forwardly advancing document, when possible, be engaged simultaneously by at least two active lower wheels (i.e. fourth wheels 62' or second wheels 62 or combinations thereof).

The preferred loader embodiment 10 of the present invention utilizes a total of eight rotating disks, there being two disks 46' within the lateral entry section 22 and six disks 46 within the document receiving section 14. Each disk 46, 46' is approximately $1\frac{1}{4}$ inches in diameter, and are spaced along the track 16 approximately $1\frac{3}{4}$ inches between their vertical centerlines.

The loader 10, as described thus far, accommodates documents having widths within a normal range, typically between four inches and nine inches. The loader 10 may be modified to also accommodate narrow width documents, i.e. documents having widths less than four inches but preferably greater than $2\frac{3}{4}$ inches.

The plurality of spaced document driver devices 44 in the receiving section 14, together with the use of three registration sensors situated between the second and third, the third and fourth, and the fourth and fifth disks 46 within the receiving section 14, permit documents having widths within the normal range to be vertically dropped anywhere within the document receiving section 14 and at document bottom edge drop angles up to approximately 30° from horizontal. In order to accommodate narrower documents, a fourth registration sensor device 100', similar to and operating in the same manner as the other three registration sensor devices 100, is situated between the fifth and sixth disks 46 within the receiving section 14 (below the exit sensor device 102). Further, a second entry sensor device 106', similar to and operating in the same manner as the entry sensor 106) is situated between the first and second disks 46' within the lateral entry section 22, permitting entry gating when either one of the sensor devices 106, 106' is triggered. In addition, it is preferred that the gating response time for narrow documents be faster than the gating response time for documents within the normal width range.

Thus there has been described a preferred embodiment of a document loader apparatus, including variations thereof, for accommodating both hand-dropped and automatically fed documents of various thicknesses and widths, together with a preloader transport for applying automatically fed documents to the loader. Further aspects of the invention have been described, including a modified track configuration and an improved light sensor device for increasing loader reliability and decreasing document jams. Other embodiments of the various aspects of the present invention, and modifications of the embodients herein presented, may be developed without departing from the essential characteristics thereof. In addition, the preloader transport, the track configuration and the light sensor improvement may each be utilized in sheet transport apparatus other than document loading. Accordingly, the invention should be limited only by the scope of the claims listed below.

I claim:

1. Apparatus for transporting a sheet along a path, comprising in combination:

a first plate member having a sheet engaging edge along said path for engaging said sheet on one side of said sheet;

a second plate member having a sheet engaging edge along said path for engaging said sheet on said one side of said sheet;

a first elastic drive belt having a sheet engaging flat surface and unsupported along said path for engaging said sheet on the other side of said sheet;

a second elastic drive belt having a sheet engaging flat surface and unsupported along said path for engaging said sheet on said other side of said sheet;

said plate members and said belts situated with said first plate member edge, said first belt surface, said second plate member edge and said second belt surface arranged in successive vertically spaced relation and such that said belts urge said sheet against said plate member edges when said sheet is engaged by said belt surfaces and said plate member edges; and means for driving said belts along said path.

2. The apparatus according to claim 1, above, further including means for feeding said sheet into said path such that said one side of said sheet is engaged by said plate member edges and said other side of said sheet is engaged by said belt surfaces.

3. The apparatus according to claim 1, above, further including means for receiving said sheet transported along said path.

4. Apparatus for transporting a document along a path, comprising in combination:

a first plate member having a document engaging edge along said path for engaging said document on one side of said document;

a second plate member having a document engaging edge along said path for engaging said document on said one side of said document;

a first elastic drive belt having a document engaging flat surface and unsupported along said path for engaging said document on the other side of said document;

a second elastic drive belt having a document engaging flat surface and unsupported along said path for engaging said document on said other side of said document;

said plate members and said belts situated with said first plate member edge, said first belt surface, said second plate member edge and said second belt surface arranged in successive vertically spaced relation and such that said belts urge said document against said belt surfaces and said plate member edges; and means for driving said belts along said path.

5. The apparatus according to claim 4, above, further including document feeder means for feeding said document into said path such that said one side of said document is engaged by said plate member edges and said other side of said document is engaged by said belt surfaces.

6. The apparatus according to claim 4, above, further including document loader means for registering and advancing said document along a track including means for enabling said document transported along said path to be received by said document loader means.

7. The apparatus according to claim 4, above, further including:

document feeder means for feeding said document into said path such that said one side of said document is engaged by said plate member edges and said other side of said document is engaged by said belt surfaces; and document loader means for registering and advancing said document along a track including means for enabling said document transported along said path to be received by said document loader means.

8. The apparatus according to claim 4, above, further including:

gating means for temporarily retaining said document at predetermined times while said document is engaged between said belts when driven and said plate edges, said belts slippedly engaging said document while retained by said gating means.

* * * * *